US006623817B1

(12) United States Patent
Yang et al.

(10) Patent No.: US 6,623,817 B1
(45) Date of Patent: Sep. 23, 2003

(54) INKJET PRINTABLE WATERSLIDE TRANSFERABLE MEDIA

(75) Inventors: Victor Yang, Longmeadow, MA (US); Norman P. De Bastiani, Hadley, MA (US)

(73) Assignee: Ghartpak, Inc., Leeds, MA (US)

( * ) Notice: Subject to any disclaimer, the term of this patent is extended or adjusted under 35 U.S.C. 154(b) by 77 days.

(21) Appl. No.: 09/789,095

(22) Filed: Feb. 22, 2001

(51) Int. Cl.[7] ..... B41M 5/00

(52) U.S. Cl. ..... 428/32.12; 428/32.14; 428/32.26; 428/32.34

(58) Field of Search ..... 428/195, 206, 428/304.4, 307.3, 325, 331, 537.5

(56) References Cited

U.S. PATENT DOCUMENTS 5,580,929 A 12/1996 Tanaka et al.
6,072,024 A 6/2000 Irizato et al.
6,083,609 A * 7/2000 Susaki et al. ..... 428/195
6,180,219 B1 * 1/2001 Hoshino et al. ..... 428/312.2

* cited by examiner

*Primary Examiner*—Cynthia H. Kelly
*Assistant Examiner*—B. Shewareged
(74) *Attorney, Agent, or Firm*—Schweitzer Cornman Gross & Bondell LLP

(57) ABSTRACT

An improved product for transferring an inkjet printed graphics to a receiving surface comprising in combination (1) a water-absorbing porous back sheet
(2) a water-soluble resin coating applied to the backing sheet,
(3) a waterproof film forming resin coating, and
(4) a waterproof inkjet receptive coating.

The combination of the foregoing results in a high quality printing and easy transfer to a receiving surface after soaking in water.

16 Claims, 1 Drawing Sheet

INKJET PRINTABLE WATERSLIDE TRANSFERABLE MEDIA

BACKGROUND OF THE INVENTION

There is a need in the art for media having excellent receptivity to inkjet printing and to provide for excellent transfer to a receiving surface. Such a product should provide an image of high resolution, relatively high gloss with bright, vivid, saturated color gamut and stencil look without requiring pasting, fuss or mess. The inkjet printable waterslide transferable media of the present invention satisfies these requirements. No such existing products are known.

So-called inkjet window decals are now available or reported in the literature. They are inkjet printable film or paper constructions with low tack pressure sensitive adhesive coated on the opposite side or static cling treatment and are die cut before one can fix them to a receiving surface. They have thick, telltale carrier film or paper. The resultant print graphics, after application, looks hazy with a distinctive film outline around the graphics. In contrast, the present waterslide transfer film is much thinner, barely visible, and gives the graphics a truer hand painting or stencil look without a telltale carrier film.

BRIEF DESCRIPTION OF THE INVENTION

The present invention comprises an inkjet printable waterslide transferable media, which comprises:

(1) a water-absorbing porous backing sheet, (2) a water soluble resin-coating applied to said backing sheet, (3) a waterproof film-forming resin coating, and (4) a waterproof inkjet receptive coating.

The waterproof inkjet receptive coating preferably comprises:

(1) a binder (2) a charge control agent (3) a cross-linking agent (4) an adhesion enhancing agent, and (5) a dispersant Basically, inkjet graphics are obtained through the printing of an inkjet printer based on its reception by the novel waterproof inkjet receptive coating layer. A novel resin-coated carrier sheet forms a tough thin film which seals and isolates the printed graphics from being dissolved by water when the imaging sheet is soaked in water. Once soaking starts, the resin dissolves and the thin film is released and glue is generated. This serves to adhere the printed graphics to the receiving surface.

Typically, the present novel media is soaked in water for 0.5 to 1 minute until the film portion of the media slides off the carrier sheet allowing transfer to a receiving surface.

The transfer receiving surfaces include regular papers, board, films, plastics, tapes, aluminum foils, metalized papers, fabrics, glass, mirror, wood, ceramic tiles, sink surface, plaster walls, furniture, cabinets, embossed wallpapers and the like.

Media applications include the areas of graphic arts, crafts, artistic and engineering drawing and design, symbols, sign, banner, poster, labeling, coding systems for advertising, communication, presentation, overhead projector, transportion, exhibition, interior decoration, outdoor display, zoo, botanical garden, or other commercial/industrial use, as well as for kids' party or play as games. The media are compatible with various inkjet printers, e.g., Epson, HP, Lexmark or Canon and their inks. The present waterslide media feature excellent receptivity to inkjet printing and generate effects of professional artwork. The printed ink is fast drying, within a minute. The image is of high resolution, relatively high gloss, and with bright, vivid, saturated color gamut and stencil look with no pasting, fuss or mess. The image is feathering/bleeding-free, smudge/scrub/scratch-resistant, and water/outdoor-weather proof.

Figure 1:
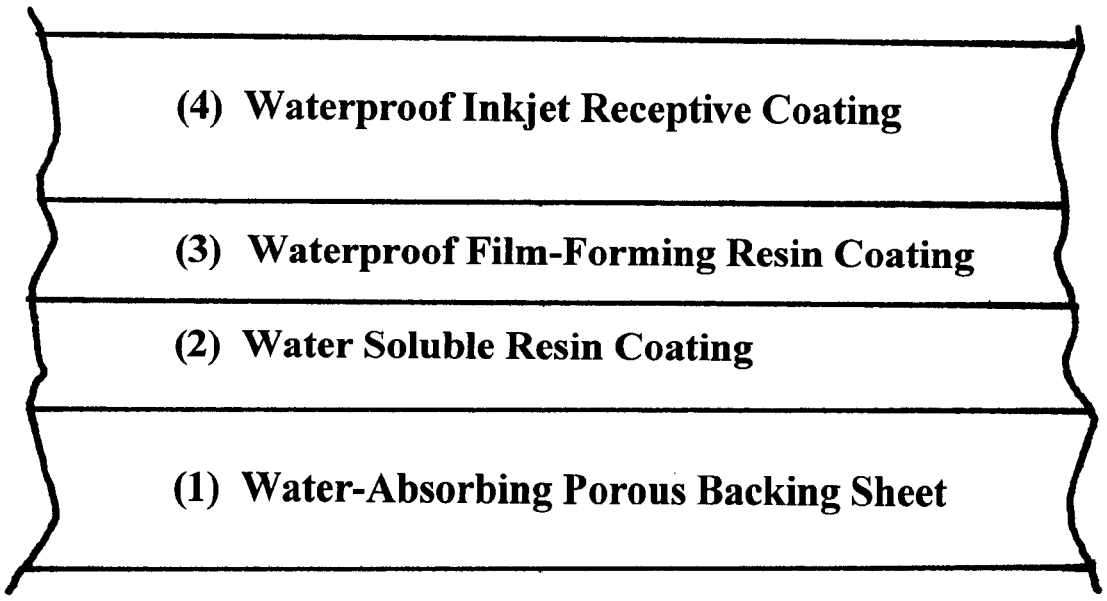
FIG. 1 illustrates the overall structure comprising the inkjet printable waterslide transferable media according to the invention, which comprises from the bottom up as illustrated.

(1) a water-absorbing porous backing sheet, (2) a water soluble resin-coating, (3) a waterproof film-forming resin coating, (4) a waterproof inkjet receptive coating.

DETAILED DESCRIPTION OF THE PRESENT INVENTION

Key elements of the present invention are further discussed as follows:

1 Water-absorbing Porous Backing Sheet

The substrates include book papers, commercial printing papers, uncoated or coated groundwood papers, paperboard, specialty kraft papers, converted papers, non-resin coated photographic background paper, clay-coated cardboard paper . . . or various paperboard alternatives.

2 Water-soluble Resin Coating

The water-absorbing porous backing sheet is coated with water-soluble polymer, either natural or synthetic type. The natural polymers include gelatin (GEL), gelatin extenders, gelatin derivatives, graft polymers of gelatin other natural polymers and synthetic hydrophilic colloidal homo-polymer and co-polymer, and aqueous dispersions of hydrophobic homo-polymer and co-polymer. Gelatin includes acid or base treated cow bone gelatin pigskin gelatin and fish gelatin. Other natural polymers include Arabic gum, albumin and casein, sugar derivatives such as cellulose (CEL) derivatives (e.g., hydroxyethyl cellulose, carboxymethyl cellulose, cellulose sulfate and cellulose acetate butyrate), sodium alginate, and starch derivatives. Synthetic polymers include polyvinyl acetate butyrate, sodium alginate, and starch derivatives, polyvinyl alcohol (PVOH), polyvinyl alcohol partial acetyl, polyethylene glycol (PEG), poly (2-ethyl-2-oxazoline) (PEOX), polyamides, acrylate derivatives (e.g., polyacrylic acid, polymethacrylic acid, polyacrylamide), polyvinyl imidazole, and polyvinylpyrazole and positively charged polyurethane.

Dispersions using hydrophobic polymers such as polyvinylidone chloride, polyethlacrylate, or hard thermoplastic acrylic co-polymers may be applicable, as well. Commercially available "Waterslide decal paper" can also be used for this purpose. For example, Tullis Russell decal paper, manufactured by the Brittain Paper Mills, located at Commercial Road, Hanley, Stock-on-Trent ST1 3QS, U. K., is applicable. One side of the Tullis Russell decal paper is coated with polyvinyl alcohol (PVA). The paperweight is in the range of 25–85 lb, preferably 35–65 lb, or more preferably, 45–55 lb.

The application is recommended at relative humidifies 50–60% (RH), preferably 55 plus or minus 2% RK and at room temperature. Trucal premium grade is a special grade paper from the family of Tullis Russell decal base. It is used for obtaining the most exacting high quality decoration of pottery, glass and vitreous enamelware, ideal for precious metals, heavy enamel effects and other demanding applications. Its nominal substance is 180 gsm, nominal gum coat 3.5 gsm, nominal caliper 220 um, moisture content in equilibrium with 50–60 % RH. The base paper is specially formulated twin wire paper, the release time is less than 60 seconds. Tryflat waterslide transfer paper is another special grade Tullis Russell paper, which can also be applied for this invention, with a similar structure to the Trucal paper, except that the nominal substrate is 180 gsm, the nominal gum coat 4.0 gsm, and the nominal caliper 220 um.

3 Waterproof Film-forming Resin Coating

A waterproof film-forming resin coating serves the following two purposes:

a. It generates a tough, thin film which carries the inkjet printed graphics to slide-off the carrier sheet after soaking in water and easily transferring to a receiving surface.

b. Once soaking starts, the water soluble resin dissolves. The thin waterproof film with the inkjet printed graphics is released, and a glue is generated by the water soluble resin, so that the thin film with the inkjet printed graphics will adhere to the receiving surface upon positioning.

The ideal polymer is a thermoplastic type. It must have precision dimensional stability. It must be waterproof and chemically inert. It must form a tough, strong, flexible film over the surface of the water-soluble resin coated on the carrier paper.

Suitable film-forming resins include polymethacrylate, polymethyl methacrylate, polybutyl methacrylate, polystyrene, polystyrene butadiene, polyethylene urethane, polyurethane acrylics, polyamide acrylics, nitrocellulose, acrylic nitrocellulose, cellulose acetate, cellulose acetate butyrate, cellulose acetate propionate, cellulose ether, polyvinyl acrylics, alkyd resin, acrylic alkyd resin, epoxide, epoxy novolac resin, epoxy ester resin, melamine resin, acrylic melamine resin, melamine formaldehyde resin, urea formaldehyde resin, phenolics, polyvinyl, polyvinyl ester, polyvinyl acetate, polyvinyl chloride, polyvinyl chloride acetate, polyvinyl alcohol, etc., specifically formulated lacquers can also be used for this purpose.

The coating is applied at room temperature and the film is formed by evaporation of the solvent.

Solvents for the resin may be chosen from hydrocarbons, including aromatic hydrocarbons, e.g., toluene, xylene, ethyl benzene, isopropyl benzene, diethyl benzene, and diphenyl ethane; hydro-aromatic hydrocarbons, e.g., cyclohexane, cyclohexene, and methyl cyclohexane; aromatic naphthas; aliphatic naphthas, e.g., petrobenzol, troluoil apcothinner, benzosol and tolusol; naval stores, e.g., dipentene, turpentine, and gum spirits; chlorinated aliphatic hydrocarbons, e.g., chloroform, carbon tetrachloride, ethylene dichloride, trichloroethylene, propylene dichloride, trichloroethane, perchloroethylene, tetrachloroethane, and methylene chloride; chlorinated aromatic hydrocarbons, e.g., monochlorobenzene, o-dichlorobenzene, and trichlorobenzene; alcohol and ethers, including monohydric aliphatic alcohols, e.g., methanol ethanol, isopropanol, sec-butanol isobutanol n-butanol, and octyl (2-ethyl hexyl) alcohol; monohydric cyclic alcohols, e.g., cyclohexanol, furfuryl alcohol, methyl cyclohexanol, tetrahydro-furfuryl alcohol benzyl alcohol phenyl ethyl alcohol, and pine oil; polyhydric alcohols, e.g., ethylene glycol, diethylene glycol glycerin, and triethanolamine; ethyl alcohol; ethers, e.g., ethyl ether, isopropyl ether, dioxane, morpholine, n-butyl ether, phenyl ether, and benzyl ether; esters, e.g., methyl acetate, ethyl acetate, isopropyl acetate, butyl acetate, amyl acetate, cyclohexyl acetate, ethyl lactate, isopropyl lactate, methyl salicytate; and ketones, including acetone, methyl ethyl ketone, methyl isobutyl ketone, diacetone alcohol, cyclohexanone, methyl cyclohexanone, acetophenone, and various commercial lacquers and clear top coats.

To obtain a white or matte background for the printed image, some white pigment or micro-sized natural or synthetic silicon dioxide may added to the film-forming coating, for instance, titanium dioxide, or Syloid 244, manufactured by Grace Davision Company, Woburn, Mass. 01801. The ratio of addition may be 1–5 percent of the total and 2–4 percent is preferred.

Various coating methodologies can be utilized. For instance, Meyer rod, bar dipping, and spray . . . etc, are applicable. The preferred coating weight is 0.1–0.5 grams $m^2$ The resultant dry film thickness is controlled in the range of 0.6–1.6 mil, and preferably, in the range of 0.8–1.2 mil.

EXAMPLES OF WATERPROOF FILM-FORMING RESIN COATING

Example 1

Heraeus L406 colorless cover coat, a composition of butyl methacrylate polymer resin, naphtha light achromatic, butyl benzyl phthalate, and trimethyl benzene, manufactured by Engelhard Chemical Company, East Norwalk, N.J. 07029, is applied by using a 30# Meyer rod, generating a wet film thickness of 3 mil. The coating is dried @ 170 F. in oven for 1 minute. The resultant dry film thickness is 1.2 mil.

Example 2

Ethocel Standard 100 resin, 14%, cellulose ether polymer, manufactured by Dow Chemical Company, located at 100 Larkin Center, Mich. 48674, is mixed with ethylene glycol-monobutyl ether, 86%, manufactured by Ashland Chemical Company, Columbus, Ohio 43216. Same coating and drying conditions as in example 1 are applied. A dry film thickness of 1.2 mil can be obtained.

Example 3

5–6 sec. RS N/C nitrocellulose dispense, manufactured by Hercules Chemical Company, Wilmington, Del. 19899, 18%, is dissolved in ethylene glycol monobutyl ether, 49%, diacetone, 13%, and mineral spirits, 9%, under agitation of 1,100 rpm, mix for 1 hour. Cool for 2 hours. Add tricresyl phosphate, 11%, mix for ½ hours. Coating the solution by #30 Meyer Rod. Dry the coating @ 170 F. in oven for 1–2 minutes. A thin film of 1.2 mil can be obtained.

Example 4

5–6 sec, SS N/C nitrocellulose resin, manufactured by Hercules Chemical Company, Wilmington, Del. 19899, 14.28%, is dissolved in ethanol 68.58%, and toluene, 17.14%, for 1 hour under agitation @ 600 rpm. Coat the solution by using 16# Meyer Rod. Dry @ 170 F. in oven for 1 minute. A thin film of 0.7 mil can be obtained.

Example 5

Solution A

Slowly add 28.2% of VYHH vinyl chloride, a coating resin manufactured by Union Carbide Company, Danbury, Conn. 06817, to isophorone, 52.25%, and cyclohexanone, 19.55%, under 1,000 rpm agitation for about 2 hour until completely dissolved.

Solution B

Slowly add cellulose acetate propinate resin, 27.8%, to propylene glycol methyl ether, 72.2%, mix for about 30 minutes until completely dissolved.

Solution C

Mix solution A, 70.6%, with A-10 acryloid resin, of Rohm and Haas Company, located at Philadelphia, Pa. 19105, 101%. Then add Solution B, 10.4%, and Irganox #1010 40%, manufactured by CIBA Company, 2%, and Plasticizer #409, manufactured by WITCO Corporation, 3%. Add Surfynol #104, 0.9%, by Air Products and Chemicals Company, Allentown, Pa. 18195, and mix @ 700 rpm until completely dissolved.

Coat Solution C using #30 Meyer Rod, and dry it @ 170 F. in oven for 1–2 minutes. A thin film of 1.2 mil can be obtained.

4. Waterproof Inkjet Receptive Coating

The waterproof ink jet receptive coating (top coat) of the present invention comprises the following components:

(a) Binder

The binders function is to bond pigment particles to one another and to the surface of the plastic or foil substrate stock. The binder determines the viscosity of the coating mix and its drying characteristics. The binder has a great deal to do with the ink acceptance (hence the printability), the smoothing or calendaring properties, water and oil resistance, and the pick strength and foldability of the coated substrate.

(b) Charge Control Agent

Conductive polymers are selected to interact with the dye molecules on the ink receptive layer. Hydrophilic cationic homo-polymers or co-polymers having positive charges that are capable of electrically absorbing negatively charged ink jet ink ions are used. The positive charge carried by the conductive polymer attracts the anionic dye ions in the ink and thus functions to localize and fix the dye.

(c) Cross-Linking Agent

Inorganic and organic compounds capable of reacting with the primary polymer matrix by forming chemical or hydrogen bonds with its hydroxyl, carboxyl, NH or other functional groups to form a strong linkage are employed. They serve to increase melting point, reduce swelling after immersion in water, waterproof the network and provide abrasion, scratch and smudge/scuff resistance.

The composition can be self-cross linking where it has hydroxyl functional groups; or other cross-linking agents such as epoxy, formaldehyde, or glyoxal can be incorporated.

(d) Adhesion Enhancing Agent

Gelatin, alpha-olefin such as polyethylene polypropylene, ethylene acrylic acid and poly-acrylic acid may be incorporated in the present composition.

(e) Dispersant

Surfactant or wetting agents are employed to reduce the surface tension of the substrate so that the normal coating can be uniformly spread without streaking or other undesirable coating defects. Examples of surfactants include anionic polymers (polyacrylic, lignosulfonate, naphthalene sulfonate), alkali silicates, nonionic polymers (fatty alcohols, ethylene oxide), and various fluorinated surfactants.

(f) Porous Ink-Absorptive Pigment

Such pigments may optionally be present where a non-glossy product is desired. In such cases, various fine-grained, micro-porous, negatively or positively charged pigments such as silica gels are preferred.

The relative proportions of the waterproof inkjet coating elements in the compositions of the present invention are set forth in Table 1 below with all percentages being on weight basis.

TABLE 1

WATERPROOF INK JET RECEPTIVE COATING

| COMPONENT | BROAD RANGE | PREFERRED RANGE | ESPECIALLY PREFERRED RANGE |
|---|---|---|---|
| (a) BINDER | 5–40% | 10–30% | 15–25% |
| (b) CHARGING CONTROL AGENT | 20–50% | 25–45% | 30–40% |
| (c) CROSS-LINKING AGENT | 0.05–3% | 0.1–2% | 0.2–1% |
| (d) ADHESIVE ENHANCING AGENT | 0.1–5% | 0.5–3% | 1–2% |
| (e) DISPERSANT | 0.05–3% | 0.1–2% | 0.5–1% |
| (f) POROUS INK-ABSORPTIVE PIGMENT | 0–3% | 0.8–2% | 0.6%–1% |

The novel coating specifically provides electrical attraction to ink jet ink and maximizes its absorption to the specific substrates utilized. The balance of the composition of the ink-receptive coating attracts and fixes ink. The polymers being utilized exhibits hydrophilic properties are electrically positive charged and thus have the ability to absorb water and negatively charged ink. The polymers contribute excellent physical properties to the product. They have hydroxyl and/or carboxyl functional groups and can be either self-cross-linked or cross-linked by the addition of epoxy or other hardening agents to obtain necessary water-resistance and anti-abrasion properties.

The following provides a further description of the key elements of the waterproof ink jet receptive coating:

(a) Binder

The binder serves to hold the final coating together after the final coating has been applied to the substrate and dried. Suitable binders include, but are not limited to, gelatin (GEL), gelatin extenders, gelatin derivatives, graft polymers of gelatin, other natural polymers and synthetic hydrophilic colloidal homo-polymer and co-polymer, and aqueous dispersions of hydrophobic homo-polymer and copolymer. Gelatin includes acid or base treated cow bone gelatin, pigskin gelatin and fish gelatin. Other natural polymers include albumin and casein, sugar derivatives such as cellulose (CEL) derivatives (e.g., hydroxyethyl cellulose, carboxymethyl cellulose, cellulose sulfate and cellulose acetate butyrate), sodium alginate, and starch derivatives. Synthetic polymers include polyvinyl acetate butyrate, sodium alginate, and starch derivatives. Synthetic polymers include polyvinyl alcohol (PVOH), polyvinyl alcohol partial acetyl polyethylene glycol (PEG), poly (2-ethyl-2-oxazoline) (PEOX), polyamides, acrylate derivatives (e.g., polyacrylic acid, polymethacrylic acid, polyacrylamide), polyvinyl imidazole, and polyvinylpyrazole and positively charged polyurethane. Dispersions using hydrophobic polymers such as polyvinylidone chloride, polyethlacrylate, or hard thermoplastic acrylic copolymers are applicable, as well. The binder is needed to support and keep the coating from cracking and becoming frail. As little binder as possible must be used, since the binder takes up space and lowers the micro pore ratio. In addition, to avoid hindering ink absorption, a non-swelling polymer must be selected. If the binder swells, it will block the penetration of ink. The supporting binder is at 20–45% solids. The weight percentage of binder is between 5–40%.

(b) Charge Control Agent

The charge control agent refers to electrically conductive compounds, which are mainly focused on ionic polymers and electronically conductive polymers including electrically positively charged conductive homo-polymer or co-polymer. The charge control agents may also be called dye mordant, which are used to fix dyes. Commonly used charge control agents are cationic molecules such as cationic polyamide, polymeric quaternary ammonium compounds and amines, sodium cellulose sulfate, quaternary polyelectrolyte polymers. Hydrophilic cationic homo-polymers or co-polymers, having positive charges are capable of electrically absorbing negatively charged ink-jet ink ions. The positive charge carried by the conductive polymer attracts the anionic dye ions in ink and thus functions to localize and fix the dyes. To perform this function efficiently, the type of the polymer carrying positive charge must be carefully selected to interact with the dye molecules on the ink receptive coating. The use of conductive polymers is disclosed in many patents, such as, for example, U.S. Pat. Nos. 2,882,157, 2,972,535, 6,615,531, 3,938,999, 4,460,679 and 4,960,687, which are incorporated by reference. Poly (vinyl benzyltrimethyl ammonium chloride)(PVBTMAC) and poly (diallydimethyl ammonium chloride)(PDADMAC), and aqueous dispersions of positively charged urethane resin are three examples of suitable conductive polymers. The weight percentage of charge control agent is between 20–50%.

The cross-linking agents of the present invention refer to inorganic and organic compounds which are capable of reacting with the prime polymer matrix by forming a chemical bond or hydrogen bond with its hydroxyl, carboxyl, NH or other functional groups to form strong linkage to increase its melting point, reduce its swell after immersion in water, and to enable the network become waterproof as well as an, abrasion/scratch/smuggler resistant material. Inorganic compounds include aluminum sulfate, potassium and ammonium alums, and zinc ammonium carbonate. Organic compounds serving as a cross-linking agent include activated esters, aldehydes, including formaldehyde, glyoxal, N-methylol, and other blocked aldehyde, aziridines, carbodimides, isoxazolium salts (unsubstituted in the 3 position of the ring), carbonic acid derivatives, carboxylic and carbamic acid derivatives, epoxides, active halogen compounds, ketones, active olefins, blocked active olefins, polymeric compounds such as dialdehyde derivatives of starch and other polysaccharides, quinones, sulfonate esters, sulfonyl halides, s-trizines, and their mixtures. The weight percentage of cross-linking agent ranges from 0.05 to 3%.

(d) Adhesion Enhancing Agent

A specific adhesion-enhancing agent is added to the ink jet composition. The agent can be a primer or resin, which is a polymer dispersion exhibiting good affinity for unprimed polyester, styrene, vinyl, polypropylene, aluminum foil or other non-porous, non-ink penetrating substrates. Suitable polymers include, but are not limited to, natural polymers and synthetic hydrophilic colloidal homopolymers and co-polymer, selected from gelatin (GEL), and aqueous dispersions of hydrophobic homopolymer and co-polymer. For instance, alpha-olefin polymer, e.g., polyethylene, polypropylene, ethylene acrylic acid, and poly-acrylic acid, are useful in this invention. Gelatin includes acid or base treated cow bone gelatin, pigskin gelatin and fish gelatin. Other natural polymers include albumin and casein, sugar derivatives such as cellulose (CEL) derivatives (e.g., hydroxyethyl cellulose, carboxymethyl cellulose, cellulose sulfate, and cellulose acetate butyrate), sodium alginate, and starch derivatives. Synthetic polymers include polyvinyl include polyvinyl alcohol (PVOH), polyvinyl alcohol partial acetyl polyethylene glycol (PEG), poly (N-vinyl) pyrrolidone (PVP), polyvinyl acetate (PVA), polyethylene oxide (PEO), poly (2-ethyl-2-oxazoline) (PEOX), polyamides, acrylate derivatives (e.g., polyacrylic acid, polymethacrylic acid, polyacrylamide), polyvinyl imidazole, and polyvinyl pyrazole. Dispersions using hydrophobic polymer such as polyvinylidone chloride, polyethlacrylate, or a hard thermoplastic acrylic co-polymer are applicable, as well. The adhesion-enhancing agent comprises 0.1 to 5-wt % of the composition.

(e) Dispersant

Suitable dispersants are a specific group of surfactants or wetting agents, which reduce the surface tension of the substrates so that the novel coating can be uniformly spread, and well carried out on the specific substrate surface without streaks, pinholes, fish eyes, comet, and other undesirable coating defects (a condition which is termed "mottle"). Ionic and non-ionic surfactants as well as fluorinated surfactants are disclosed in many patents, such as, for example, U.S. Pat. Nos. 2,600,831, 2,719,087, 2,982,651, 3,026,202, 3,428,456, 3,457,076, 3,454,625, 4,267,265, 4,510,233, 4,847,186 and 4,916,054 and European Patents 245,090 and 319,951, which are incorporated by reference.

Examples of applicable surfactant include Ninol 96 SL, methyl ester of lauramide DEA, Makon 10, alkoxylate from Stepan Maplofix 563, sodium lauryl sulfonate from Onyx Hostapur SAS 93, secondary alkanesulfonate, sodium salt, from American Hoechst Daxad 11, sodium naphthalenesulfonate-formaldehyde dispersant from Hampshire Igepal nonyl phenoxy poly (ethyleneoxy) ethanol Mona-70E, sodium dioctyl sulfosuccinate, Monateric CAB-LC, cocamidopropyl betaine, Monamid 716, lauramide DEA, linear alkyl benzene sulfonate from Mona, Triton X-100, octyl phenoxy polyethoxy ethanol, Triton X-200, alkylaryl polyether sulfonate from Rohm & Haas, Surfynol 104, acetylenic diol (2,4,7,9 tetramethyl-5-decyne-4, 7 diol) from Air Products, FC-170C, fluorochemical from 3M, Bio-Soft D-40, sodium dodecyl benzene sulfonate, Slip-Ayd SL-530, polyethylene in 2-butoxythanol from Daniel Products, and Pluronic L-61, polyoxyethylene-polyoxypropylene glycol from BASF.

The dispersant will comprise 0.05 to 3-wt % of the composition.

(f) Porous Ink-absorptive Pigment

The component is used where a non-glossy product is desired. Aluminum oxide, alumina hydrate, boehmite, precipitated calcium carbonate, titanium dioxide, fumed silica, precipitated silica, polymethylmeth-acrylate (PMMA), starch, polytetrefluoro-ethylene (PTFE) can be used. Better results can be obtained with fine-grained, micro-porous, neutrally or positively charged pigments, for instance, silica gels. Silica gel consists of primary particles of 2–20 nm, which from agglomerates of 2–10 microns; specifically, the grades with higher absorption capacities and cationic serve better. Silica is the only one of the white pigments which available in grade with oil absorption value greater than 100 g-oil/100 g pigments. Silica gel is preferred to the other types of silica because of its availability in particular particle sizes, which give a more open coating structure per particle volume, and because the silica gel particles do not break down under shear during mixing operations. Sub micron silica gels, average particle size no more than 0.3 micron, with positive zeta potential in aqueous solution or slurry, are preferred. The pigment comprises 0 to 3-wt % of the present coating. When producing a non-glossy product, it typically will comprise 0.8–2-wt % of the composition.

Method of Coating for Waterproof Inkjet Receptive Layer

Various coating methodologies can be utilized. For instance, Meyer rod, bar dipping, slot, air-knife curtain, roll, direct gravure, reverse gravure, three or four roll reverse roll gravure, micro-gravure, spray . . . etc, are applicable. The preferred coating weight is 4–5 grams/$m^2$.

Cross-linking agents or hardeners are added and well mixed into the final solution just before the coating. If gelatin is used, an on-fine mixer can be used as a manner of continuous hardener addition with the final solution. The jacket temperature needs to be precisely controlled so that the solution final is maintained at 37–43 degrees C., or 99–110 degrees F., during the entire coating operation.

When gelatin is used as a binder, the moving web travels into a chiller and then into a dryer. The chiller causes the gelatin-based coating to gel or solidify. In this manner, the coating is prevented from intermixing during the drying thereof in the dryer. In the dryer, ink jet composition is dried (i.e., the solvent is removed). More precisely, all but residual solvent is removed from the coating, residual solvent is that solvent which is chemically or physically bound to the binder or is otherwise not removable by drying under ambient conditions. In other words, when substantially dry, the solvent content of the binder tends to be in a nearly steady state equilibrium with the environment at ambient temperature, pressure, and humidity. For example, when gelatin is used as the binder, water is normally used as the solvent/vehicle fluid for the coating. Depending upon the particular type of gelatin used, the coating is dried in dryer for a period of about 1.5 to 9 minutes, at a temperature of about 60 degrees to 130 degrees F. Residual water typically amounts to between 5% and 20% water, by weight, in substantially dried gelatin, again depending upon the particular type of gelatin used. If synthetic polymer binders are used instead of gelatin, a chiller is not needed. The preferred oven temperature is 170–1800 F. (80–85° C.) for 45 minutes or equivalent. After initial drying, the coated roll should be left to stay overnight at room temperature to receive a natural incubation before it can be used for ink jet printing. Coating weight is measured by "cut and weight" technique.

TESTING

The following test procedures are utilized in evaluating the product of the present invention.

1 Printing

Print your image design from Internet download or other digital resources using an Inkjet printer Print either Apple, HP, Canon, or Epson Stylus Inkjet printers with test patterns containing colored blocks (cyan, magenta, yellow, red, green, blue and black). The black ink may be composite or pigmented, however, the composite is preferred. Use settings: "Photo Quality Glossy Film", on "Custom" mode, Print Quality: Photo 1440 dpi, High Quality Half toning, Photo Enhanced, Sharpness: High. Drying time: record ink drying time right after the printing. Waterproof test: leave under running tap water for two hours. Smudge test: under tap water, smudge the image using a finger.

2 Graphics Transfer (1) Make sure the receiving surface is clean and dry
(2) Use a scissors to cut the desired graphics as precise as possible
(3) With a wet sponge, cloth, or paper towel, thoroughly soak water-absorbing porous backing paper several times. Or soak the entire cut graphics together with the backing sheet in water for 1–1½ minutes.
(4) Gently slide off a thin film with the graphics off the side of the porous backing paper. If not slidable, stop and wet again until the thin film is movable and totally slide away from the backing paper carrying the water-soluble adhesive with it
(5) Position the image carried by the thin film to the receiving surface, graphics side up, adhesive side down, against the receiving surface
(6) Gently press the image and make necessary adjustment until the image perfectly positioned
(7) Use a dry sponge, cloth, or paper towel, smooth graphics and gently absorb excess water, and let dry.

The graphics is now permanently adhered to the receiving surface.

EXAMPLES

Example 1

Base Backing Sheet with Water Soluble Resin Coating

Waterslide decal base, Tullis Russell Trucal premium grade decal, a Brittns Decalcomania paper, is manufactured by Brittains Paper Mills. Its nominal substance is 180 gsm; gum coat at 3.5 gsm caliper 220 um, moisture content in equilibrium at 50–60% RH. Its base paper is specially formulated twin wire paper, and its release time is less than 60 seconds. It is coated with polyvinyl alcohol (PVA) on one side. The paperweight is about 55 lb.

Waterproof of Resin Coating

Heraeus L406 colorless cover coat, a butyl methacrylate polymer mixed with naphtha light aromatic, butyl benzyl phthalate, trimethyl benzene, made by Englehard Chemical Company, was coated by using a 30# Meyer rod to the above mentioned carrier paper. The coating was dried @ 170 F. in over for 1 minute.

Inkjet Receptive Coating

The following components were mixed at room temperature to form the ink jet receptive coating. 1 gram of slurry or aqueous dispersed silica gel, average size at 0.3 micron with a positive zeta potential, (commercially available from Grace), was added to 6 grams of OF-280, a cationic co-polymer, dimethyldiallyl-ammonium chloride/acrylic acid with an 80/20 ratio and 35% activity molecular weight 250–400K, (commercially available from Calgon Company). 32 grams of IJ-2, positively charged polyurethane (commercially available from Esprit Company) were then added under agitation and well mixed. 35 grams of tap water were added. 8 grams of 10% aqueous solution of Daxad 11, Sodium napthalenesulfonate-formaldehyde dispersants (commercially available from Hampshire Corporation) were added afterwards.

Two grams of Lucidene 901 polyethylene acrylic acid (commercially available from Morton Corporation) were then added to the mixture. 2.2 grams of Carboset GA-33, acrylic dispersion having less carboxyl function group in the molecule, (available from BF Goodrich) were then mixed in. Twenty grams of additional tap water were finally added to the mixture. Right before coating, 0.2 grams of CR-5L a cross-linking agent from Esprit Company, were added and mixed. Then 19.51 grams of 0.4% Glyoxal HCOCHO dialdehyde, (commercially available from Aldrich Fine Chemicals Company) were added to the final composition. The pot life of the mix was about 24 hours. A #24 Meyer rod was used to coat the mixture. The coating was dried at 120 C. in oven for 1 minute, then incubated at room temperature over night. The coating was printed in the Epson Stylus Photo 1270, under the program of "ink jet transparences" at the resolution of 1440 dpi. Testing results showed that the image was dried less than 1 minute.

A desired graphics was precisely cut by using a scissors. The portion carrying the graphics was soaked in water for 1 minute. A thin film with the graphics was then gently slid off the side of the backing paper. The image carried by the thin film was positioned to the receiving surface, graphics side up, adhesive side down, against the receiving surface. A dry paper towel was used to smooth graphics and gently to absorb excess water. The graphics was let dry for 15 minutes. The image became permanently adhered to the receiving surface. It was water fast and resistant to smudge, scrubbing and scratching.

Example 2

Base Backing with Water Soluble Coating

Tullis Russell Trucal premium grade decal paper, is made by Brittain Paper Mills. Its nominal substance is 180 gsm, gum coat 3.5 gsm, caliper 220 um, moisture content in equilibrium at 50–60% RH. The base paper is specially formulated twin wire paper, and its release time is less than 60 seconds. It is coated with polyvinyl alcohol(PVA) on one side. The paperweight is about 55 lb.

Waterproof Resin Coating

5–6 sec, SS N/C resin, manufactured by Hercules Chemical Company, 14.28%, was added to ethanol, 68.58% and toluene, 17.14%, under agitation @ 600 rpm until completely dissolved.

The solution was coated using 16# Meyer Rod. The sample was dried at 170° F. in an oven for 1 minute. A thin film of 0.7 mil was obtained.

Inkjet Receptive Coating

Part A: 600 grams of poly (diallyldimethylammonium chloride), commercially available from Aldrich, 20% by weight in water, average molecular weight 400–500K, under vigorous agitation were mixed with 3200 grams of IJ-2 (commercially available from Esprix Company), 3500 grams of distilled water were then added after 800 grams of 10% by weight aqueous solution of Triton X-100, Polyoxyethylene-polyoxypropylene glycol a wetting agent, (commercially available from Rohm & Haas Company), were added afterwards. 20 grams of Pruronic L-61, Octylphenoxypolyethoxyethanol nonionic surfactant, a defoamer, (commercially available from BASF Corporation), were added to the mixture. 200 grams of Carboset CR-761 (commercially available from BF Goodrich Company), were added to the mixture 20 grams of CR-5L, an aliphatic epoxy compound (commercially available from Esprix), were added.

Part B: 600 grams of pigskin pharmaceutical grade gelatin, 11337 Type 56, (commercially available from SKW Biosystems), was soaked in 2000 grams of cold distilled water for 30 minutes. The temperature was raised to 40 degrees C. or 104 degrees F. and the solution was agitated for another 30 minutes.

Coating Final: at 40 degrees C. or 104 degrees F., part A was mixed with part B.

In-line Mix: using a stationary mixer at weight ratio of 60 mL/min of coating final to 11 mL/min of 10% aqueous solution of GXL-100, pyridinium, 1-[(dimethylamino)-carbonyl]-4-(2-sufoethyl), inner salt (commercially available from Esprix). A slot coating station was used. The coating speed was 300 fpm. The coating temperature was maintained at 37–43 degrees C. (99–110 degrees F.). The drying paths included a chill zone, several low temperature zones, medium temperature zones, high temperature zones (up to 77 degrees C. or 170 degrees F.), and a balance zone (see the drying description in the ink receptive coating part of this application) with a total length of 100 meters (328 feet). The dried coating roll was incubated at room temperature for 1 week.

A print was made from Internet download using Epson Stylus 1270 Photo Inkjet printer with setting: "Photo Quality Glossy Film", on "Custom" mode, Print Quality: Photo 1440 dpi, High Quality Half toning, Photo Enhanced, Sharpness: High. The ink drying time right after the printing was 1 minute.

The print was placed under running tap water for two hours. No washout was observed. The image was tested for finger smudging. The print was not damaged in any way. It was proven to be water-fast, smudge, scrub, and scratch resistant.

The adhesion between the ink receptive coating and the substrate was tested acceptable. A desired graphics was precisely cut by using a scissors. The portion carrying the graphics was soaked three times using a wet paper towel. A thin film with the graphics was then gently slid off the side of the backing paper.

The image carried by the thin film was positioned to the receiving surface, graphics side up, adhesive side down, against the receiving surface. A dry paper towel was used to smooth graphics and gently to absorb excess water. The graphics was let dry for 15 minutes. The image became permanently adhered to the receiving surface. Image transfer was completed to satisfaction. The product was deemed acceptable for use as means of transferring of graphics generated from an inkjet printer.

Various modifications can be made by those skilled in the art without departing from the spirit of the present invention. Accordingly, reference would be made to the following claims to determine the full scope of the invention.

What is claimed is:

1. A composition for waterslide transferring an inkjet printed graphics to a receiving surface, in combination:

(1) a water-absorbing porous backing sheet, (2) a water soluble resin coating on a top surface of said backing sheet, (3) a waterproof film-forming resin coating on a top surface of said water soluble resin coating, and (4) a waterproof inkjet receptive coating on a top surface of said film-forming resin coating.

2. The waterproof inkjet receptive coating of claim 1 comprising in combination:

(1) a binder, (2) a charge control agent, (3) a cross-linking agent, (4) an adhesion enhancing agent, and (5) a dispersant.

3. The coating composition of claim 1 which is free of feathering and bleeding as well as resistant to water.

4. The composition of claim 2 wherein said charge control agent is a hydrophilic cationic polymer having positive charges capable of electrically absorbing negatively charged ink ions.

5. The composition of claim 2 wherein said cross-linking agent is capable of reacting by formation of chemical or hydrogen bonds to form a strong linkage.

6. The composition of claim 2, which further contains a porous ink absorption pigment.

7. The composition of claim 6 whereas said pigment is a silica gel.

8. The composition of claim 2 wherein the dispersant reduces the surface tension of a substrate to be coated so that the coating can be uniformly spread without streaking.

9. The coating composition of claim 2, which contains on a weight percent basis:

(1) 5 to 40% binder, (2) 20 to 50% charge control agent, (3) 0.05 to 3% cross-linking agent, (4) 0.1 to 5% adhesion enhancing agent, and (5) 0.05 to 3% dispersant.

10. The composition of claim 2, which further contains 0 to 3 wt % of a porous ink absorptive pigment.

11. The waterproof inkjet receptive coating of claim 2 having the following composition on a weight percent basis (1) 10 to 300% binder, (2) 25 to 45% charge control agent, (3) 0.1 to 2% cross-lining agent, (4) 0.5 to 3% adhesion enhancing agent, and (5) 0.1 to 2% dispersant.

12. The composition of claim 1, which further contains 0.8 to 2% of a porous ink absorptive pigment.

13. A waterslide transferable inkjet printable medium for digital printing, in combination:

(5) a water-absorbing porous backing sheet, (6) a water soluble resin coating, on a top surface of said backing sheet, (7) a waterproof film-forming resin coating, on a top surface of said water soluble resin coating, and (8) a waterproof inkjet receptive coating on a top surface of said film-forming resin coating.

14. The inkjet printable medium of claim 13 wherein said inkjet receptive coating has the composition of claim 2.

15. The inkjet printable medium of claim 13 wherein said inkjet receptive coating has the composition of claim 9.

16. The printing medium of claim 13 having from bottom to top components (1)–(4).

* * * * *

UNITED STATES PATENT AND TRADEMARK OFFICE

CERTIFICATE OF CORRECTION

PATENT NO. : 6,623,817 B1 
DATED : September 23, 2003
INVENTOR(S) : Yang et al.

It is certified that error appears in the above-identified patent and that said Letters Patent is hereby corrected as shown below:

Title page,
Item [73], Assignee, change "Ghartpak, Inc.," to -- Chartpak, Inc., --.

Signed and Sealed this

Third Day of February, 2004

JON W. DUDAS
*Acting Director of the United States Patent and Trademark Office*